US005421054A

United States Patent [19]

Dawson et al.

[11] Patent Number: 5,421,054

[45] Date of Patent: Jun. 6, 1995

[54] SWIMMING POOL CLEANER DISCS

[75] Inventors: Andrew W. Dawson, Westleigh; John T. Evans, Frenchs Forest, both of Australia; Alain J. Gazzola, Lyon, France; Robert W. Marklew, Pompano Beach, Fla.; Chris A. Rice, Boca Raton, Fla.; Desroy D. Smith, Ft. Lauderdale, Fla.

[73] Assignee: Zarina Holding C.V., Amsterdam, Netherlands

[21] Appl. No.: 103,930

[22] Filed: Aug. 6, 1993

[51] Int. Cl.[6] ..... E04H 4/16

[52] U.S. Cl. ..... 15/246; 15/1.7

[58] Field of Search ..... 15/1.7, 246, 257.01; 366/247, 317, 343, 605

[56] References Cited

U.S. PATENT DOCUMENTS

| | | | |
|---|---|---|---|
| 4,095,378 | 6/1978 | Urakami | 15/1.7 |
| 4,152,802 | 5/1979 | Chauvier | 15/1.7 |
| 4,193,156 | 3/1980 | Chauvier | 15/1.7 |
| 4,193,469 | 3/1980 | Graf | 180/164 |
| 4,351,077 | 9/1982 | Hoffman | 15/1.7 |
| 4,530,125 | 7/1985 | Hoffman | 15/1.7 |
| 4,642,833 | 2/1987 | Stoltz et al. | 15/1.7 |
| 4,742,593 | 5/1988 | Kallenbach | 15/1.7 |
| 4,849,024 | 7/1989 | Supra | 15/1.7 |
| 4,852,211 | 8/1989 | Strausak | 15/1.7 |
| 4,949,419 | 8/1990 | Kallenbach | 15/1.7 |
| 4,979,986 | 12/1990 | Hill et al. | 366/317 |
| 5,014,382 | 5/1991 | Kallenbach | 15/1.7 |
| 5,198,156 | 3/1993 | Middleton et al. | 366/317 |

FOREIGN PATENT DOCUMENTS

| | | | |
|---|---|---|---|
| 2355353 | 5/1975 | Germany | 366/317 |

OTHER PUBLICATIONS

Two photographs of a blue disc for a swimming pool cleaner (available to at least one of the named inventors prior to Aug. 6, 1993).

Two photographs of a beige disc and bearing the handwritten notation "Jandy" (available to at least one of the named inventors prior to Aug. 6, 1993).

Two photographs of a blue disc and bearing the handwritten notation "Kreepy Krauly" (available to at least one of the named inventors prior to Aug. 6, 1993).

One photograph of a black disc and bearing the handwritten notation "Baracuda" (available to at least one of the named inventors prior to Aug. 6, 1993).

*Primary Examiner*—Edward L. Roberts, Jr.

*Attorney, Agent, or Firm*—Kilpatrick & Cody

[57] ABSTRACT

Discs and a footpad for devices such as automatic swimming pool cleaners are disclosed. The discs incorporate upwardly-extending, non-truncated fins protruding radially from their peripheries. The peripheries themselves, moreover, define a plurality of tongues for increased flexibility, and both the discs and footpad may include ramped segments facilitating movement over obstacles extending from swimming pool surfaces.

13 Claims, 3 Drawing Sheets

SWIMMING POOL CLEANER DISCS

This invention relates to discs and associated equipment for cleaners of liquid-containing vessels and more particularly to automatic pool cleaners having finned discs for improved maneuverability in swimming pools.

BACKGROUND OF THE INVENTION

U.S. Pat. Nos. 4,351,077 to Hofmann and 4,642,833 to Stoltz, et al., incorporated herein in their entireties by this reference, disclose automatic, water-interruption-type suction swimming pool cleaners having flexible annular discs. These discs are typically mounted near the inlets of the suction cleaners and designed to contact pool surfaces when in use. By doing so, the discs decrease the tendency of the cleaners to disengage from pool surfaces, particularly when the cleaners are negotiating transition regions between walls and floors.

U.S. Pat. No. 4,193,156 to Chauvier, also incorporated herein in its entirety by this reference, describes (at column 4, lines 5–55) an annular disc having numerous "concertina-like," "circumferentially spaced folds." These folds extend when their associated swimming pool cleaner encounters a transition region, purportedly "keeping the inflow of water into the mouth opening to a minimum." The underside of the disc is grooved, moreover, according to the Chauvier patent, to assist in removing dust from the floors and walls of swimming pools.

Other existing swimming pool cleaner discs, including one provided by Jandy Industries, Inc., contain upwardly-extending protrusions about their peripheries. The protrusions of the Jandy disc are truncated so that they do not extend beyond the disc's periphery, however, and the periphery itself is wholly circular. Another disc distributed outside the United States combines the upwardly-extending protrusions with a scalloped periphery. Again, however, the protrusions are truncated and thereby do not extend beyond the periphery of the disc. The vertical peripheral faces of the truncated protrusions of this disc function as stops, causing the disc to move around certain obstacles extending from internal pool surfaces rather than, for example, lodging under them or moving over them.

SUMMARY OF THE INVENTION

The present invention provides alternative flexible discs for devices such as automatic swimming pool cleaners. Unlike the discs described above, the present invention incorporates upwardly-extending, non-truncated fins protruding radially from the peripheries of the discs. The serpentine peripheries themselves, moreover, define a plurality of tongues, providing increased flexibility over even existing scalloped discs. Concurrently, the fins supply sufficient rigidity to the discs of the present invention to enable them to ride over various objects, including many drains, lights, valves, and nozzles, projecting from internal surfaces of pools.

Additional features of the present invention include a curved radius between the fins and the lower surface of the disc, providing a smooth transition therebetween. The disc underside also contains an integrally-formed ramped segment surrounding its (nominally circular) central aperture. This ramp assists the pool cleaner in negotiating obstacles, supplying a smooth progression from the disc bottom to the bottom of the cleaner footpad (which the disc surrounds in use), which too may include a ramp. Multiple openings through the disc enable fluid to pass from one surface of the disc to the other, maintaining a boundary fluid layer between the lower surface of the disc and the adjacent surface of the pool. These openings facilitate movement of the disc relative to the pool cleaner and allow dirt and debris to be entrained in the flow of fluid through the openings and in the boundary layer.

It is therefore an object of the present invention to provide a disc incorporating upwardly-extending, non-truncated fins protruding beyond its periphery.

It is another object of the present invention to provide a disc having a serpentine periphery forming a plurality of tongues for increased flexibility.

It is a further object of the present invention to provide a disc facilitating movement of an automatic swimming pool cleaner over various objects projecting from internal surfaces of pools.

It is an additional object of the present invention to provide a disc having a curved radius between fins and its lower surface.

It is yet another object of the present invention to provide a disc having an underside containing a ramped segment surrounding its central aperture.

It is, moreover, an object of the present invention to provide a disc including multiple openings therethrough, enabling fluid to pass from one surface of the disc to the other.

It is a further object of the present invention to provide a ramped footpad for use in connection with an automatic swimming pool cleaner.

Other objects, features, and advantages of the present invention will become apparent with reference to the remainder of the text and the drawings of this application.

DETAILED DESCRIPTION

Figure 1:
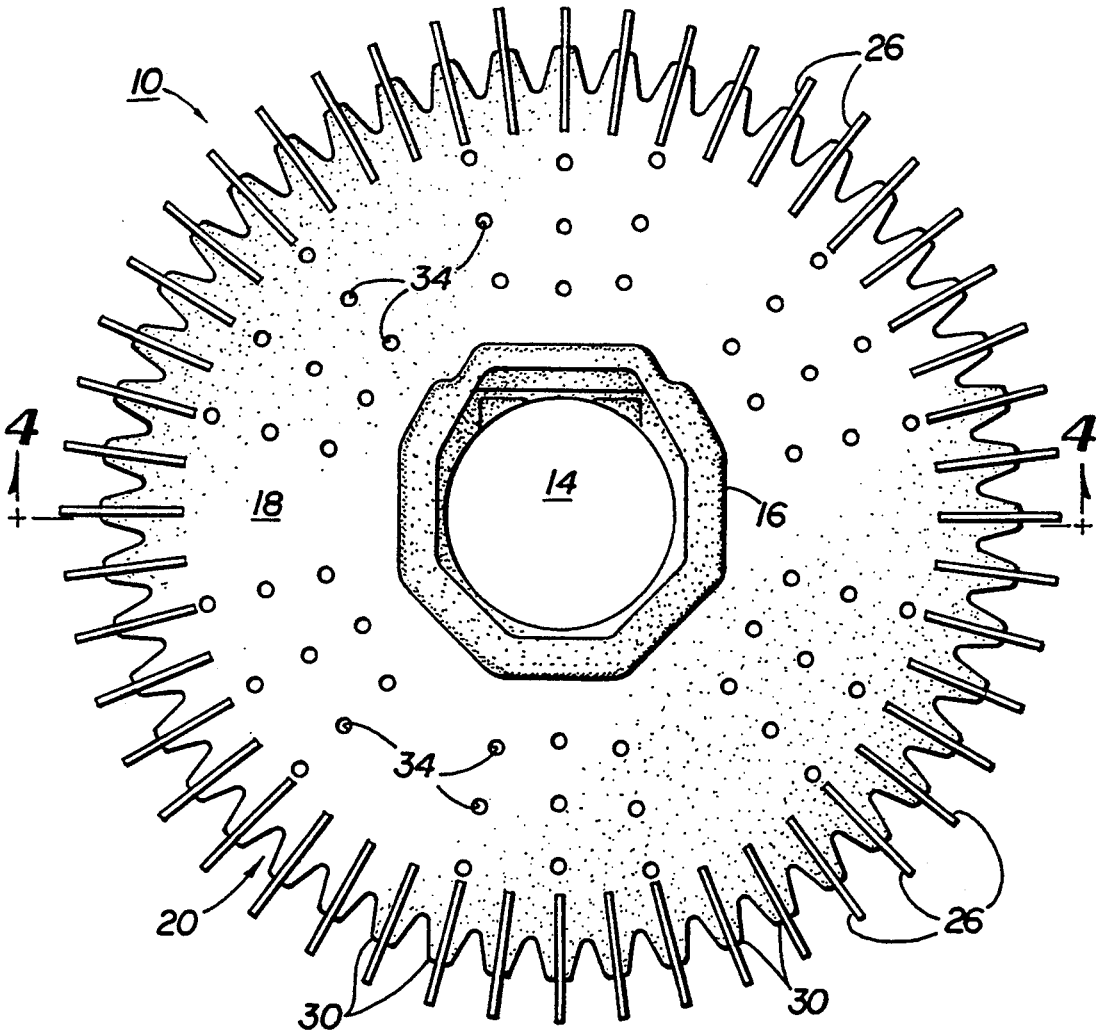
FIG. 1 is a top plan view of a disc (and footpad) of the present invention.
Figure 2:
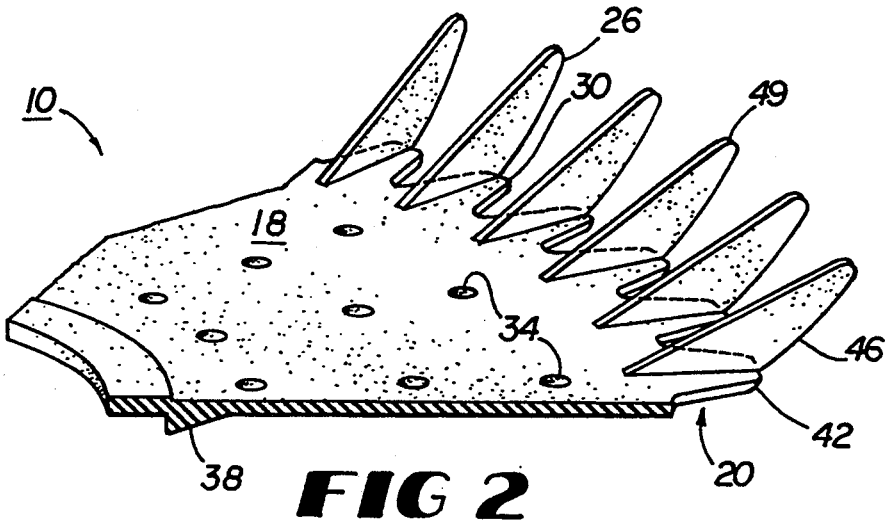
FIG. 2 is a perspective view of a portion of the disc of FIG. 1.
Figure 3:
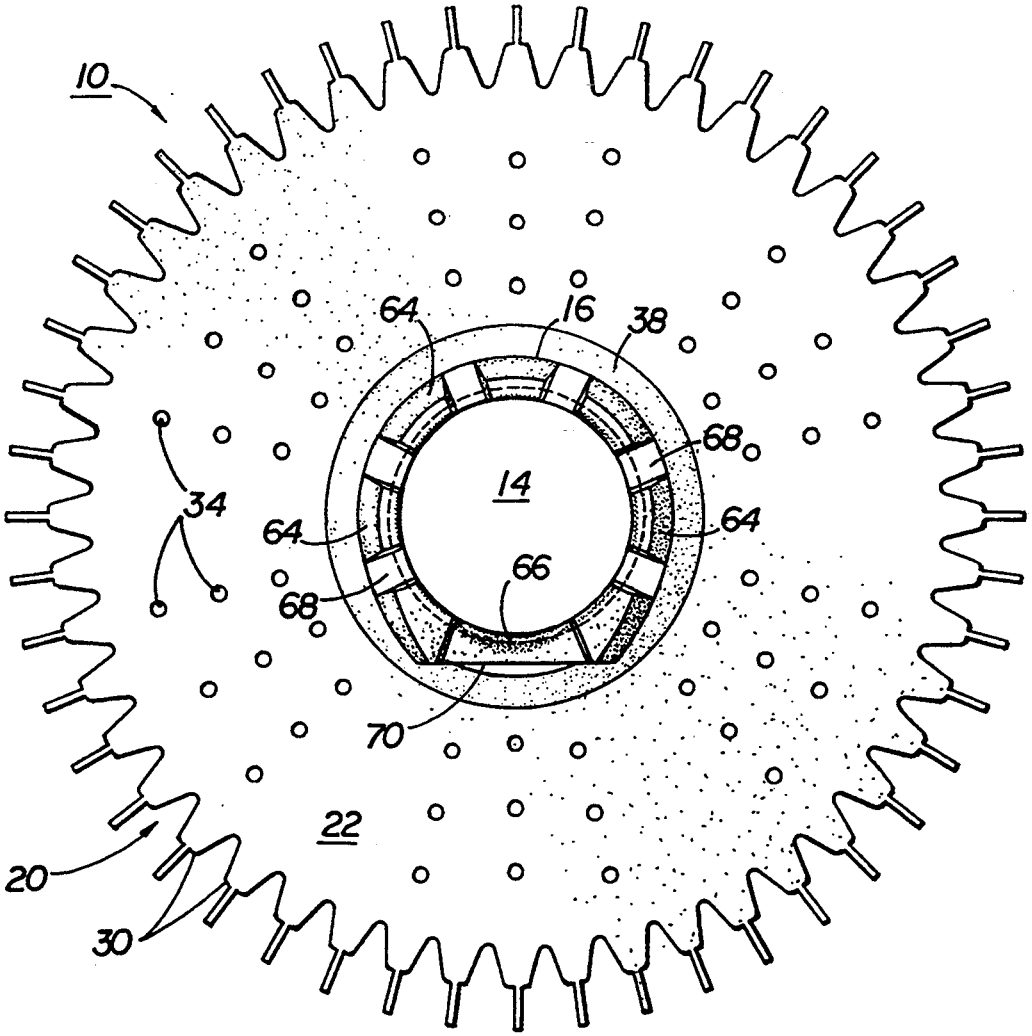
FIG. 3 is a bottom plan view of the disc and footpad of FIG. 1.

FIGS. 1–4 illustrate disc 10 of the present invention. Disc 10 defines a central aperture 14, nominally circular, in which a footpad 16 of an automatic swimming pool cleaner may be received, for example. Disc 10 also defines a generally planar upper surface 18, a periphery 20 and, as shown in FIG. 3, a lower surface 22. Extending upward from and spaced about upper surface 18 are fins 26, which assist disc 10 in maneuvering over many objects (such as drains, lights, valves, and nozzles) projecting from internal surfaces of pools. Fins 26 additionally extend beyond periphery 20, causing them to contact most projections before the remainder of disc 10.

FIGS. 1–3 also detail the serpentine nature of periphery 20. The shape of periphery 20 defines multiple tongues 30, increasing the flexibility of disc 10 and on which an equivalent number of fins 26 are positioned.

Although forty-eight tongues are shown in FIG. 1, such number of tongues (and fins) is not required and may vary as necessary or desired. Openings 34 through disc 10 enable fluid to pass between upper and lower surfaces 18 and 22 of disc 10 when in use, maintaining a boundary fluid layer between the lower surface 22 of disc 10 and the adjacent surface of the pool or other structure to be cleaned.

Figure 4:
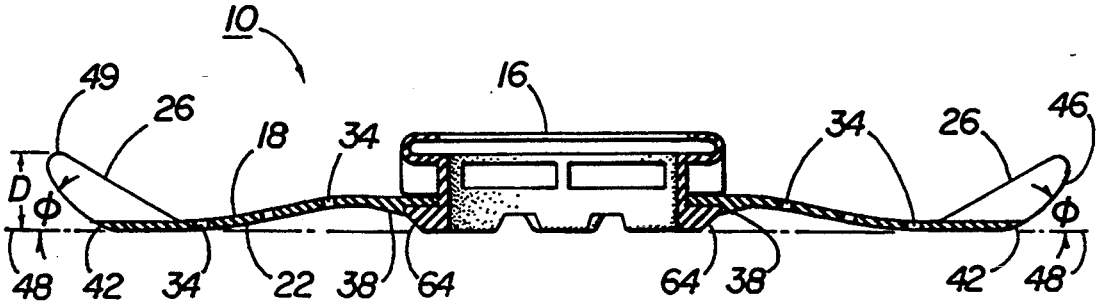
FIG. 4 is a cross-sectional view of the disc and footpad of FIG. 1 taken along lines 4—4 of that figure.

Shown in FIGS. 2–4 is ramp 38, projecting from lower surface 22 of disc 10 and positioned concentrically about central aperture 14. Ramp 38 promotes a smooth transition between lower surface 22 and the bottom of footpad 16 (or other component) received by central aperture 14, facilitating unobstructed movement of a swimming pool cleaner associated with the footpad 16. FIGS. 2 and 4 similarly disclose radius 42 existing between fins 26 and lower surface.22 of disc 10, providing a smooth transition therebetween.

In an embodiment of the invention consistent with FIGS. 1–4, fins 26 are spaced approximately every 7.5° about periphery 20. This spacing of fins 26 precludes sufficiently small-diameter objects from becoming entangled between adjacent fins 26 as an associated swimming pool cleaner moves about the surfaces of a pool. Instead, fins 26, including radii 42 and the remainders of their curved leading edges 46, are designed to ride over the objects, thereby carrying the associated swimming pool cleaner over the obstacles as well. Evenly spacing fins 26 about periphery 20 and having them extend radially from periphery 20 cause disc 10 to be more flexible than, for example, having the entirety of its periphery 20 raised (like a dinner plate). Fins 26 additionally assist in bending disc 10 to remain in contact with vertical or angled walls extending from the bottom surface of the swimming pool.

FIG. 4 details various angular and distance relationships between a fin 26 and disc 10. As shown in FIG. 4, leading edge 46 of fin 26 forms an angle "$\phi$" with axis 48, an extension of a radius of lower surface 22, while "D" describes the distance between the uppermost portion 49 of fin 26 and axis 48. In at least one embodiment of the invention, $\phi$ is approximately 45° and D equals 1.06 inches. Fins 46 may be made of plastic or other flexible material and integrally molded with disc 10, facilitating uniformity of these angular and distance relationships between fins 26 of a disc 10 and between discs 10 themselves. In some embodiments, disc 10 has an approximate diameter of fourteen inches measured from the center of central aperture 14 to the outermost extension of fins 46.

Figure 5:
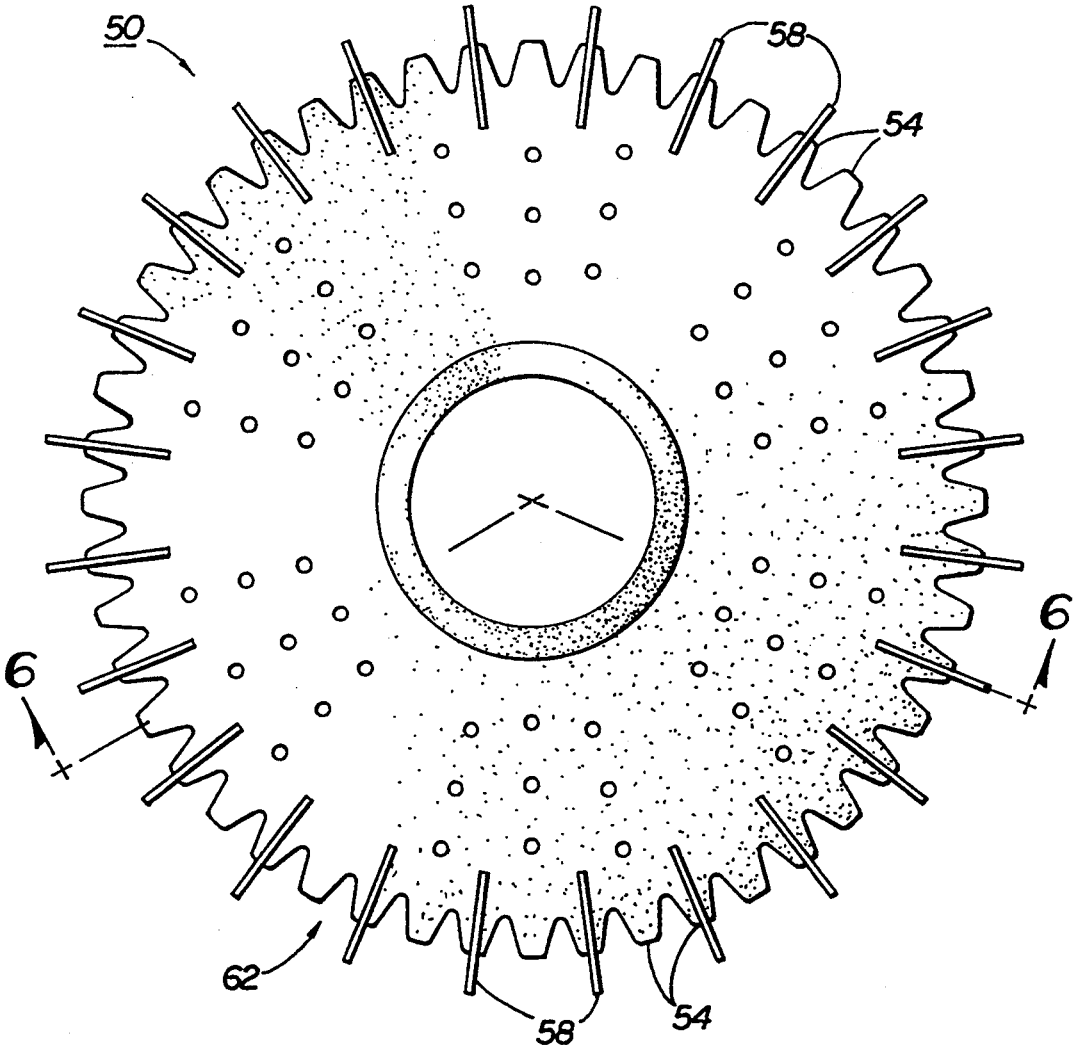
FIG. 5 is a top plan view of an alternate disc of the present invention.
Figure 6:
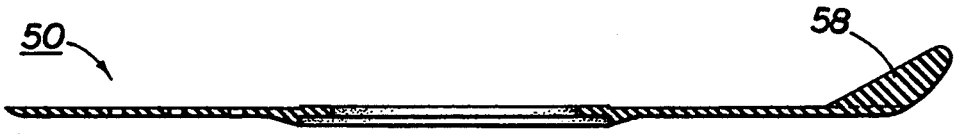
FIG. 6 is a cross-sectional view of the disc of FIG. 5 taken along lines 6—6 of that figure.

FIGS. 5–6 illustrate an alternate disc 50 of the present invention. Although including tongues 54 and fins 58 similar to disc 10, the number of each is not identical. Rather, twice as many tongues 54 as fins 58 are present for disc 50. Consequently, fins 58 are positioned (at approximately 15° intervals) about the periphery 62 of disc 50 on alternating tongues 54. The increased spacing between fins 58 permits larger leaves and other debris to pass between them to the inlet of the swimming pool cleaner to which disc 50 may be attached in use. At the same time, tongues 54 lacking associated fins 58 remain sufficiently flexible so that they bend when encountering obstacles, enabling the adjacent fins 58 and tongues 54 to continue passing over the obstacles.

Although discs 10 and 50 can be attached to existing footpads, footpad 16 shown in FIGS. 1, 3, and 4 provides an alternative device for connecting a disc to an automatic swimming pool cleaner. Like ramp 38 of lower surface 22, the outer surfaces 64 of footpad 16 are sloped to continue the smooth transition from lower surface 22 to the mouth of an automatic swimming pool cleaner. Rear interior surface 66 is similarly ramped or sloped to facilitate dislodging a swimming pool cleaner from small diameter obstacles extending from the pool surface. Footpad 16 additionally includes slots 68 and 70 through which water and entrained debris may flow. As illustrated in FIGS. 3 and 4, slots 68 are spaced approximately 45° about footpad 16, with larger slog 70 occupying the rear of the footpad 16.

The foregoing is provided for purposes of illustrating, explaining, and describing embodiments of the present invention. Modifications and adaptations to these embodiments will be apparent to those of ordinary skill in the art and may be made without departing from the scope or spirit of the invention.

What is claimed is:

1. A disc adapted for use as part of an automatic swimming pool cleaner, comprising:

a. an upper surface;

b. a lower surface;

c. a periphery;

d. a plurality of fins integrally formed with and extending upward from the upper surface beyond the periphery;

e. means, comprising a central aperture, for receiving the automatic swimming pool cleaner; and f. an annular ramp integrally formed with the lower surface, surrounding the central aperture, and sloping downward from the lower surface toward the central aperture.

2. A disc according to claim 1 further comprising a plurality of radially-spaced tongues, at least some of which are integrally formed with the plurality of fins.

3. A disc according to claim 2 in which the number of radially-spaced tongues equals the number of fins.

4. A disc according to claim 2 in which the number of radially-spaced tongues is twice the number of fins.

5. A disc according to claim 4 further comprising a plurality of openings through which fluid may pass from the lower surface to the upper surface when the automatic swimming pool cleaner is immersed in the fluid.

6. A disc according to claim 5 in which the plurality of fins number forty-eight, each fin spaced approximately 7.5° about the periphery of the disc.

7. A disc according to claim 5 in which the plurality of fins number twenty-four, each fin spaced approximately 15° about the periphery of the disc, and the plurality of radially-spaced tongues number forty-eight.

8. A molded plastic, flexible disc having a central aperture and adapted to receive a footpad of an automatic swimming pool cleaner, comprising:

a. a planar upper surface;

b. a lower surface defining (1) a plurality of openings to the upper surface through which fluid may pass when the automatic swimming pool cleaner is immersed in the fluid and (2) an axis along a selected radius;

c. a periphery defining a plurality of radially-spaced tongues;

d. a plurality of fins extending upward from the upper surface beyond the periphery, each fin (1) having a leading edge defining an angle of approximately 45° with the axis, (2) having an uppermost portion approximately 1.06 inches from the lower surface, and (3) being integrally formed with a tongue of the plurality of radially-spaced tongues; and e. an annular ramp integrally formed with the lower surface, concentric with the central aperture, and sloping downward from the lower surface toward the central aperture.

9. Equipment adapted for use as part of an automatic swimming pool cleaner, comprising:

a. a flexible disc having a central aperture and comprising:

i. a planar upper surface;

ii. a lower surface defining (1) a plurality of openings to the upper surface through which fluid may pass when the automatic swimming pool cleaner is immersed in the fluid and (2) an axis along a selected radius;

iii. a periphery defining a plurality of radially-spaced tongues;

iv. a plurality of fins extending upward from the upper surface beyond the periphery, each fin being integrally formed with a tongue of the plurality of radially-spaced tongues; and v. an annular ramp integrally formed with the lower surface, concentric with the central aperture, and sloping downward from the lower surface toward the central aperture; and b. a footpad defining a sloped surface attached to and continuous with at least a portion of the annular ramp when the equipment is in use.

10. Equipment according to claim 9 in which the footpad further comprises:

a. a sloped interior surface for facilitating dislodging the automatic swimming pool cleaner from obstacles encountered in use; and b. a plurality of slots through which fluid may flow when the automatic swimming pool cleaner is in use.

11. A disc adapted for use as part of an automatic swimming pool cleaner, comprising:

a. an upper surface;

b. a lower surface;

c. a periphery;

d. means, comprising a central aperture, for receiving the automatic swimming pool cleaner; and e. a ramp integrally formed with the lower surface, surrounding the central aperture, and sloping downward from the lower surface toward the central aperture.

12. A disc according to claim 11 in which the ramp has a triangular cross section.

13. A disc according to claim 12 further comprising a plurality of fins integrally formed with and extending upward from the upper surface beyond the periphery and in which the ramp is annular.

* * * * *